US011432640B2

(12) United States Patent
Garvey et al.

(10) Patent No.: US 11,432,640 B2
(45) Date of Patent: Sep. 6, 2022

(54) HYDRATION RESERVOIR WITH HANDLE

(71) Applicant: Samsonite IP Holdings S.a r.l., Luxembourg (LU)

(72) Inventors: Brendan Garvey, Salt Lake City, UT (US); Matthew Connors, Salt Lake City, UT (US)

(73) Assignee: Samsonite IP Holdings S.a r.l., Luxembourg (LU)

( * ) Notice: Subject to any disclaimer, the term of this patent is extended or adjusted under 35 U.S.C. 154(b) by 119 days.

(21) Appl. No.: 16/405,784

(22) Filed: May 7, 2019

(65) Prior Publication Data

US 2020/0352311 A1 Nov. 12, 2020

(51) Int. Cl.
*A45F 3/20* (2006.01)
*B65D 33/06* (2006.01)

(52) U.S. Cl.
CPC ..... *A45F 3/20* (2013.01); *B65D 33/06* (2013.01)

(58) Field of Classification Search
CPC ..... B65D 33/06; A45F 3/20
USPC ..... 220/752, 759; 383/12, 13, 17, 20
See application file for complete search history.

(56) References Cited

U.S. PATENT DOCUMENTS

| | | | | |
|---|---|---|---|---|
| 1,726,761 | A | | 9/1929 | Palmer |
| 1,959,782 | A | | 5/1934 | Fenwick et al. |
| 2,049,220 | A | | 7/1936 | Pearce |
| 3,299,442 | A | | 1/1967 | White et al. |
| 3,814,288 | A | | 6/1974 | Westrich |
| 4,254,771 | A | * | 3/1981 | Vidal ..... A61F 5/441 604/325 |
| 4,386,720 | A | | 6/1983 | Speedie |
| 4,526,298 | A | | 7/1985 | Boxer et al. |
| 4,732,299 | A | | 3/1988 | Hoyt |
| 4,836,416 | A | | 6/1989 | Shalgi et al. |
| 5,364,189 | A | | 11/1994 | Kuge et al. |
| 5,727,714 | A | | 3/1998 | Fawcett |
| 5,806,726 | A | | 9/1998 | Ho |
| 5,806,904 | A | | 9/1998 | Smith |
| 5,913,456 | A | | 6/1999 | Dikeman |

(Continued)

FOREIGN PATENT DOCUMENTS

| | | | |
|---|---|---|---|
| CN | 202987773 | U | 6/2013 |
| DE | 9408454 | U | 9/1994 |

(Continued)

OTHER PUBLICATIONS

Osprey, "3 Liter Hydraulics Reservoir", Obtained at url: http://www.ospreypacks.com/en/product/cycling/hydraulics_reservoir_3_liter, known as early as Oct. 19, 2015, 3 pages.

(Continued)

*Primary Examiner* — J. Gregory Pickett
*Assistant Examiner* — Niki M Eloshway
(74) *Attorney, Agent, or Firm* — Dorsey & Whitney LLP

(57) ABSTRACT

A hydration reservoir is provided. The hydration reservoir may include a bladder for storing fluid defining a front panel and a rear panel. A fill opening may be defined in the front panel. An outlet port may be defined in the front panel and spaced away from the fill opening at a distance. A handle assembly may be coupled to the front panel. The handle assembly may include a spine layer coupled to the front panel and a handle protruding from the spine layer. The handle may be spaced away from the fill opening.

20 Claims, 7 Drawing Sheets

(56) References Cited

U.S. PATENT DOCUMENTS

| | | | | |
|---|---|---|---|---|
| 6,142,344 | A | 11/2000 | Kai | |
| 6,164,821 | A | 12/2000 | Randall | |
| D447,413 | S | 9/2001 | Ducorday | |
| 6,296,388 | B1 | 10/2001 | Galomb et al. | |
| 6,385,992 | B1 | 5/2002 | Flore | |
| 6,457,863 | B1 | 10/2002 | Vassallo | |
| 6,488,186 | B2 | 12/2002 | Gaiser et al. | |
| 6,497,348 | B2 | 12/2002 | Forsman et al. | |
| 6,675,998 | B2 | 1/2004 | Forsman et al. | |
| 6,722,533 | B2 | 4/2004 | Skillern | |
| 6,820,780 | B2 | 11/2004 | Forsman et al. | |
| 6,854,888 | B1 | 2/2005 | Brown et al. | |
| D505,540 | S | 5/2005 | Lien | |
| 6,908,015 | B2 | 6/2005 | Choi et al. | |
| D517,308 | S | 3/2006 | Khalifa | |
| 7,014,077 | B2 | 3/2006 | Brown | |
| 7,063,243 | B2 | 6/2006 | Forsman et al. | |
| 7,070,075 | B2 | 7/2006 | Forsman et al. | |
| 7,073,688 | B2 | 7/2006 | Choi et al. | |
| 7,083,063 | B2 | 8/2006 | Lien | |
| D538,030 | S | 3/2007 | Karl et al. | |
| D539,027 | S | 3/2007 | Gressock et al. | |
| 7,293,676 | B2 | 11/2007 | Liston et al. | |
| 7,311,231 | B2 | 12/2007 | Noell et al. | |
| 7,398,891 | B2 | 7/2008 | Yang | |
| D581,152 | S | 11/2008 | Karl et al. | |
| 7,448,509 | B2 | 11/2008 | Yang | |
| 7,490,740 | B2 | 2/2009 | Robins et al. | |
| 7,533,783 | B2 | 5/2009 | Choi et al. | |
| 7,568,673 | B2 | 8/2009 | Evingson | |
| 7,600,657 | B2 | 10/2009 | Wang | |
| 7,762,432 | B2 | 7/2010 | Fidrych et al. | |
| 7,806,300 | B1 | 10/2010 | Noell et al. | |
| 7,820,946 | B2 | 10/2010 | Woodfill et al. | |
| D640,466 | S | 6/2011 | Staton | |
| 8,020,730 | B2 | 9/2011 | Liang et al. | |
| 8,142,075 | B2 | 3/2012 | Shaw | |
| 8,177,097 | B2 | 5/2012 | Duran | |
| 8,182,151 | B2 | 5/2012 | Dodgen | |
| 8,191,727 | B2 | 6/2012 | Davies et al. | |
| 8,267,283 | B2 | 9/2012 | Staton | |
| 8,322,923 | B2 * | 12/2012 | Gum | B65D 33/10 383/26 |
| D677,123 | S | 3/2013 | Kemp et al. | |
| D683,018 | S | 5/2013 | Herivel et al. | |
| 8,622,263 | B2 | 1/2014 | Su | |
| 8,820,579 | B2 | 9/2014 | Wood | |
| 8,887,962 | B2 | 11/2014 | Goodner et al. | |
| 9,149,109 | B2 | 10/2015 | Slaton | |
| 9,210,990 | B2 | 12/2015 | Hoskins | |
| 9,302,822 | B2 | 4/2016 | Hoskins | |
| D806,476 | S | 1/2018 | Karl, IV et al. | |
| 9,950,827 | B1 | 4/2018 | Lau et al. | |
| 9,962,023 | B1 | 5/2018 | Lauritano | |
| 9,994,362 | B2 | 6/2018 | Hoskins | |
| D830,050 | S | 10/2018 | Gordon et al. | |
| 10,315,816 | B2 | 6/2019 | Ehyai et al. | |
| 10,390,604 | B2 | 8/2019 | Lyon et al. | |
| D903,298 | S | 12/2020 | Favela et al. | |
| 2003/0094464 | A1 | 5/2003 | Decottignies | |
| 2004/0128747 | A1 | 7/2004 | Bumbarger et al. | |
| 2004/0211778 | A1 | 10/2004 | Lien et al. | |
| 2004/0217117 | A1 | 11/2004 | Lien | |
| 2006/0151534 | A1 * | 7/2006 | Mares | A45F 3/20 222/175 |
| 2007/0012733 | A1 * | 1/2007 | Horito | A45F 3/04 224/148.2 |
| 2007/0223842 | A1 | 9/2007 | Sabounjian et al. | |
| 2007/0280565 | A1 | 12/2007 | Lyon et al. | |
| 2008/0002917 | A1 * | 1/2008 | Wang | A45F 3/20 383/35 |
| 2009/0236341 | A1 | 9/2009 | McKinney et al. | |
| 2010/0012221 | A1 | 1/2010 | Lien | |
| 2011/0006084 | A1 * | 1/2011 | Staton | A45F 3/20 222/175 |
| 2011/0132932 | A1 | 6/2011 | Duran | |
| 2011/0174844 | A1 | 7/2011 | Hindle | |
| 2011/0290798 | A1 | 12/2011 | Corbett et al. | |
| 2012/0111876 | A1 | 5/2012 | Pfotenhauer | |
| 2014/0374413 | A1 * | 12/2014 | Lyon | B31B 50/60 220/4.13 |
| 2015/0016753 | A1 | 1/2015 | Batarseh | |
| 2015/0076180 | A1 * | 3/2015 | Hoskins | A45F 3/20 224/148.2 |
| 2015/0093052 | A1 | 4/2015 | Hoskins | |
| 2016/0113379 | A1 | 4/2016 | Marui | |
| 2017/0086568 | A1 | 3/2017 | Ehyai et al. | |
| 2017/0127806 | A1 | 5/2017 | Smith et al. | |
| 2019/0269228 | A1 | 9/2019 | Czerwinski et al. | |
| 2019/0270562 | A1 | 9/2019 | Ehyai et al. | |
| 2020/0229578 | A1 * | 7/2020 | Hoskins | A45F 3/20 |

FOREIGN PATENT DOCUMENTS

| | | | |
|---|---|---|---|
| EM | 0084829470001 | | 3/2021 |
| EM | 0084829470002 | | 3/2021 |
| EM | 0084829470003 | | 3/2021 |
| JP | 2002136573 | A | 5/2002 |
| JP | 3594280 | B2 | 11/2004 |
| WO | 2011003110 | A2 | 1/2011 |
| WO | 2015047213 | A1 | 4/2015 |
| WO | 2015098920 | A1 | 7/2015 |

OTHER PUBLICATIONS

Osprey, "Hydraulics Reservoir Review", Obtained at url: http://www.outdoorgearlab.com/Hydration-Bladder-Reviews/Osprey-Hydraulics-Reservoir, known as early as Oct. 19, 2015, 6 pages.

Commercial Product: Sea to Summit Pack Tap; obtained at https://www.youtube.com/watch?v=v9M6wu2R3Uo; Youtube Video 2016, 1 page.

* cited by examiner

HYDRATION RESERVOIR WITH HANDLE

TECHNICAL FIELD

The present disclosure relates generally to hydration systems, and more specifically to hydration reservoirs with handles allowing for easy handling of the hydration reservoir.

BACKGROUND

Hydration reservoirs typically are constructed of multiple layers of film and act to carry a liquid for a user to drink during an activity, such as bike riding, running, skiing, or the like. Such hydration reservoirs have a fill opening for filling the reservoir or bladder with a fluid. It is undesirable to directly hold these layers when filling the bladder as such handling prevents the layers from separating and the bladder from fully expanding. Some conventional hydration reservoirs have a tab connected to the structure of the fill opening for a user to hold onto when filling the bladder to prevent interference with bladder expansion. However, such tabs can be awkward to grab and hold. Further, slight movement of such a tab may shift the fill opening and disrupt the flow of fluid therethrough.

It is therefore desirable to provide an improved hydration system, and more specifically an improved handle for a hydration reservoir that addresses the above described problems and/or which more generally offers improvements or an alternative to existing arrangements.

SUMMARY

According to the present disclosure there is provided a hydration reservoir as described below and defined in the accompanying claims. The present disclosure advantageously provides a hydration reservoir with an improved handle. As explained in detail below, through use of a handle of the present disclosure, the reservoir may be easily repositioned and moved.

Embodiments of the present disclosure may include a hydration reservoir. The hydration reservoir may include a bladder for storing fluid defining a front panel and a rear panel. A fill opening may be defined in the front panel. An outlet port may be defined in the front panel and spaced away from the fill opening at a distance. A handle assembly may be coupled to the front panel. The handle assembly may include a spine layer coupled to the front panel and a handle protruding from the spine layer. The handle may be spaced away from the fill opening.

Additionally or separately, the fill opening may be formed by a fill opening collar extending outwardly from the front panel.

Additionally or separately, the handle may have a grip portion defining opposing ends. One of the opposing ends may engage the spine layer near the fill opening. Additionally or separately, the other of the opposing ends may engage the spine layer at a location closer to the outlet port than the fill opening. Additionally or separately, a gap may be formed between the spine layer and the grip portion. Additionally or separately, the other of the opposing ends may be free and the grip portion may define a cantilever.

Additionally or separately, the spine layer may be coupled to the front panel at a location spaced away from the fill opening. Additionally or separately, the spine layer may be coupled to the front panel along a portion of the distance between the fill opening and the outlet port. Additionally or separately, the spine layer may be coupled to the front panel continuously. Additionally or separately, the spine layer may extend to and encompass the outlet port. Additionally or separately, the spine layer may be formed by a long strip of sheet material coupled to the front panel by bonding.

Additionally or separately, the hydration reservoir may include a baffle. The baffle may be positioned inside the bladder. The baffle may be coupled between the front and rear panels and may extend along at least a portion of the distance between the fill opening and the outlet port. The spine layer may be at least partially co-extensive with the baffle.

Additionally or separately, the handle assembly may include at least two materials. The spine layer may include a first material, and the grip portion may include a second material. The first material and second material may be different from one another.

Additionally or separately, at least one of the front panel and the rear panel may be molded into a three-dimensional shape.

Other examples or embodiments of the present disclosure may include a fluid reservoir. The fluid reservoir may include a flexible bladder. The bladder may include a fill opening, an outlet port for connecting to an outlet hose and spaced away from the fill opening, and a handle assembly. The handle assembly may be secured to the flexible bladder at a location spaced away from the fill opening. The handle assembly may include a spine layer coupled to the flexible bladder and a handle extending from the spine layer to form a gap between the handle and the spine layer.

Additionally or separately, the spine layer may include at least two anchors positioned a distance apart. The handle may include at least two cavities positioned at opposing ends of the handle. At least two cavities may couple with the at least two anchors to couple the handle with the spine layer.

Additionally or separately, the handle may include a top surface, a bottom surface, and two opposing ends. Each end may include an attachment structure that couples the respective end to the spine layer. A distance between the top surface and the bottom surface may define a thickness of the handle. The thickness of the opposing ends may be greater than the thickness of a middle region of the handle.

Additionally or separately, the handle assembly may include a first end proximate the fill opening and a second end proximate the outlet port. The gap may be larger proximate the first end than proximate the second end.

Additional examples or embodiments of the present disclosure may include a reservoir for storing a fluid. The reservoir may include a bladder for storing a fluid. The bladder may include a front panel and a rear panel. A fill opening may be defined by the front panel. A handle assembly may be coupled with the front panel by a spine layer. The spine layer may be coupled with the reservoir at a location spaced away from the fill opening.

Additionally or separately, the spine layer may be linear and may extend longitudinally along a portion of a length of the front panel.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various embodiments of the disclosure and should not be construed as a complete recitation of the scope of the disclosure, characterized in that.

DETAILED DESCRIPTION

This disclosure is related to a hydration reservoir with an improved handle assembly. Depending on the embodiment, the hydration reservoir may include a bladder for storing a fluid, a fill opening, which may also be referred to as a fill port, an outlet port, and a handle assembly. The bladder may include front and rear panels. The fill opening may be defined within the front panel at one end of the front panel and may include a collar for attaching a cap to selectively close the fill opening. The outlet port may be positioned over an outlet aperture that is defined in the front panel at an opposing end from the fill opening or port, defining a distance between the outlet port and the fill opening. The outlet port may include an outlet reinforcement panel that surrounds the outlet port to decrease stress around the periphery of the outlet aperture. The handle assembly may include a spine layer and a handle. In one embodiment, the spine layer extends along the top surface of the front panel at least a portion of the distance defined between the fill opening and the outlet port. The handle extends from the spine layer to form a gap between the handle and the spine layer. Depending on the embodiment, the handle may extend along a portion of the length of the spine layer or along the entire length of the spine layer. In some embodiments, the handle is coupled to the spine layer at opposing ends of the handle.

In operation, a user may easily grab and maneuver the hydration reservoir via the handle assembly. For example, a user may hold the handle with one hand and remove a cap covering the fill opening with the other hand to fill the reservoir with fluid. As another example, a user may lift the hydration reservoir by the handle to place the hydration reservoir inside a bag, such as a backpack. The handle assembly provides a sturdy means of holding, maneuvering, and positioning the hydration reservoir while empty or while containing fluid.

Figure 1:
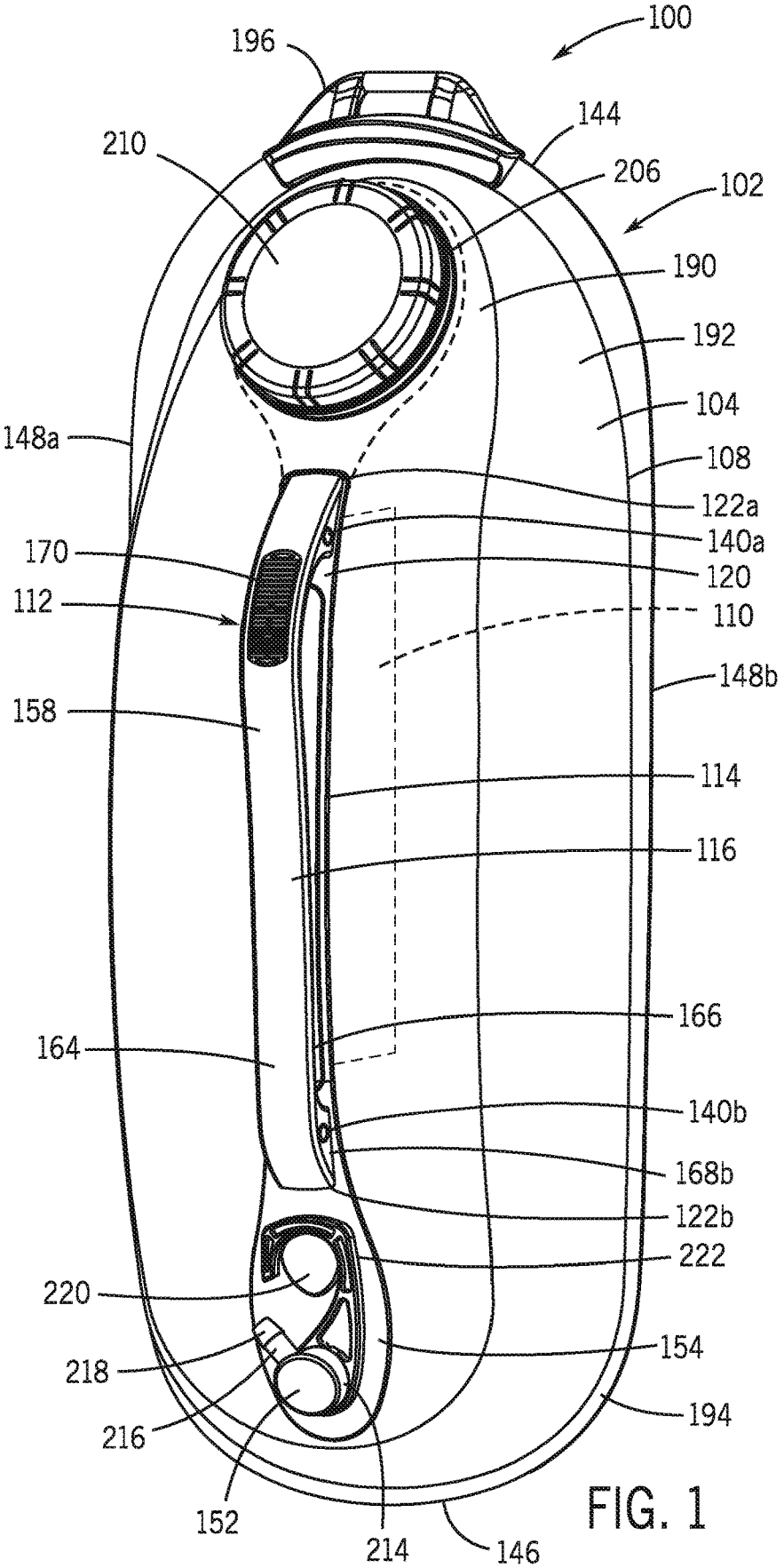
FIG. 1 is a perspective view of a hydration reservoir in accordance with some examples of the present disclosure.

Turning now to the figures, a hydration reservoir 100 according to an embodiment of the present disclosure is shown in FIG. 1. The hydration reservoir 100 includes a bladder 102 formed from at least two panels (e.g. a front panel 104 and a rear panel 106) of resilient material secured together. For example, the bladder 102 may be formed by adhering the front and rear panels 104,106 to each other along an engagement line 108, forming a seal, to create a bladder 102 that can contain liquids for consumption while performing sport activities, for instance. The front and rear panels 104,106 may each be formed from one or more layers of flexible film, each layer of film ranging from about 0.10 mil to about 0.40 mil thick. In the embodiment of FIG. 1, the engagement line 108 forming the seal between the front and rear panels 104,106 defines the periphery of a bladder volume. In this example, the front and rear panels 104,106 are joined together at the respective peripheral edges to define the bladder 102 and a bladder volume for storing drink fluid therein, such as water, sports drinks, and juices. The size and shape of the bladder 102 may vary depending on the desired application with which the hydration reservoir 100 will be used. For example, the hydration reservoir 100 may be placed in a hydration pack or other carrier to hold and dispense fluid to a user when desired. Typically, the bladder 102 may hold as much as 24 ounces, and in some examples may hold as much as 32 ounces, 50 ounces, 70 ounces, 100 ounces, 200 ounces, or more of drink fluid. In some embodiments, the front and rear panels 104,106 may deform as the bladder 102 is emptied of liquid to, for example, limit the buildup of vacuum pressure within the bladder 102 and limit sloshing of the drink fluid within the bladder 102. In some embodiments, the bladder 102 may include an internal baffle 110 that is coupled at one edge to the front panel 104 and the other edge to the rear panel 106, such that the internal baffle 110 separates the front and rear panels 104,106.

With reference to FIGS. 1-7, a hydration reservoir 100 of the present disclosure includes a handle assembly 112. The handle assembly 112 may include a spine layer 114 and a handle 116 protruding from the spine layer 114. The spine layer 114 may couple the handle assembly 112 to the front panel 104 of the hydration reservoir 100. For example, the spine layer 114 may have a panel engagement surface 118 that couples with the front panel 104 of the hydration reservoir 100 and a handle engagement surface 120 that couples with the handle 116. The spine layer 114 may be coupled to the front panel 104 along at least a portion of the length of the spine layer 114, such as between handle ends 122*a,b*. In some embodiments, the area of engagement between the spine layer 114 and the front panel 104 is sized to spread out the load of a filled bladder 102 across more area. The spine layer 114 may be sufficiently flexible such that the panel engagement surface 118 seats flush against the front panel 104 surface (e.g., curves with the curvature of the front panel 104 surface if the front panel 104 surface is curved). In some embodiments, the entire panel engagement surface 118 is coupled to the front panel 104 surface. In other embodiments, only a portion of the panel engagement surface 118 is coupled to the front panel 104 surface. For example, the spine layer 114 may be coupled to the front panel 104 surface at opposing ends of the spine layer 114, and an intermediate portion of the spine layer 114 (e.g., a portion of the spine layer 114 between the opposing ends) may not be coupled to the front panel 104 surface. As another example, the spine layer 114 may be intermittently coupled to the front panel 104. The spine layer 114 may be coupled to the front panel 104 by various conventional means, such as, for example, welding, bonding, adhesion, and the like.

Figure 4:
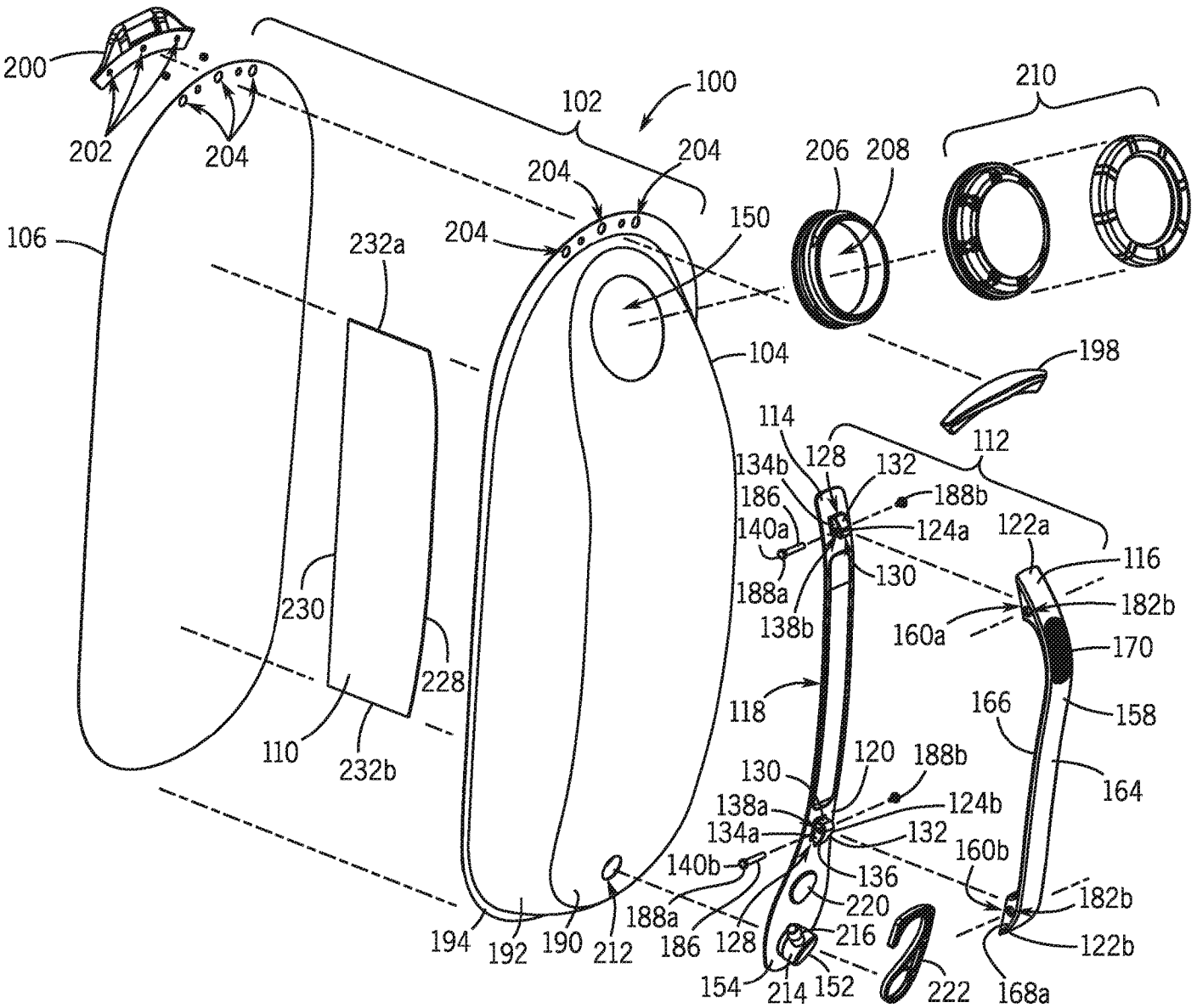
FIG. 4 is an exploded view of the hydration reservoir of FIG. 1 in accordance with some examples of the present disclosure.
Figure 5A:
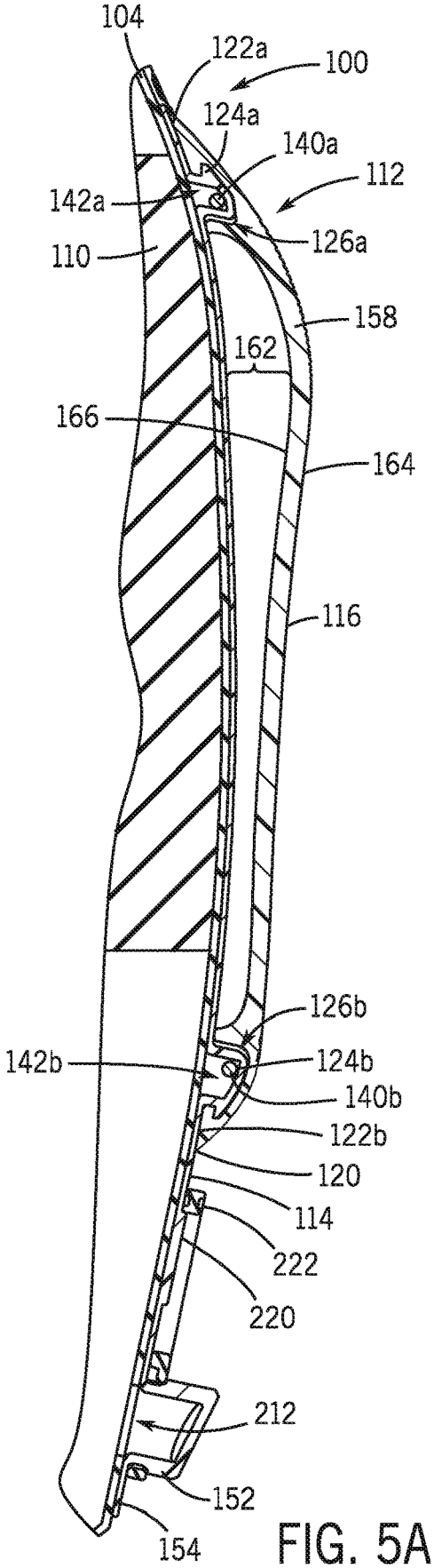
FIG. 5A is a cross-section view of a handle assembly of the hydration reservoir of FIG. 1 taken along line 5A-5A of FIG. 2 in accordance with some examples of the present disclosure.
Figure 5B:
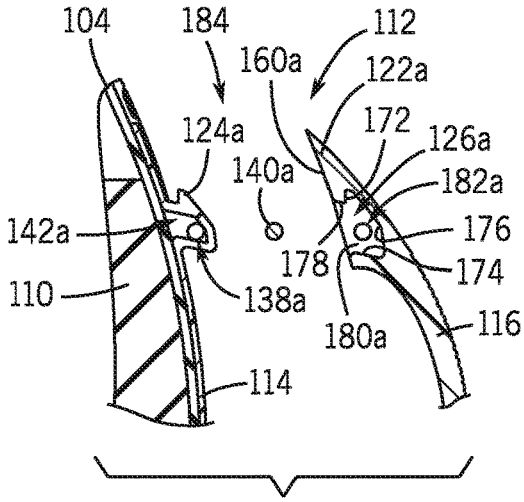
FIG. 5B is an isolated cross-sectional view of a connection assembly of the handle assembly of FIG. 5A.
Figure 5C:
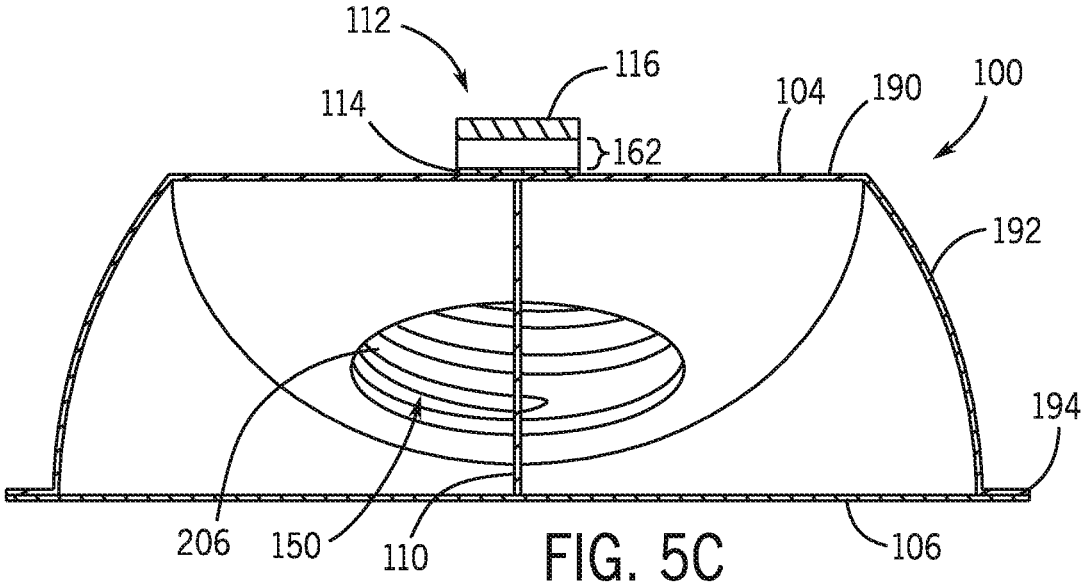
FIG. 5C is a cross-section view of the hydration reservoir of FIG. 1 taken along line 5C-5C of FIG. 3 in accordance with some examples of the present disclosure.

The handle engagement surface 120 of the spine layer 114 may include one or more anchors 124*a,b* to couple the handle 116 to the spine layer 114. In one example, and as shown in FIGS. 4-5B, the handle engagement surface 120 has two anchors 124*a,b* extending therefrom. The anchors 124*a,b* in this example each have a post structure that is shaped to be received in a recess or cavity 126*a,b* formed in a respective end 122*a,b* of the handle 116. Each anchor 124*a,b* is secured in the respective handle cavity 126*a,b* so that the hydration reservoir 100 may be moved by a user engaging the handle 116. For example, each anchor 124*a,b* may include a retention member (e.g., a pin); however, it is contemplated that each anchor 124*a,b* may be secured to the respective cavity 126*a,b* by other conventional fasteners, press fit engagement, adhesives, or combinations of the same. As shown in FIGS. 4-5B, each anchor 124*a,b* may include a front wall 128, a back wall 130, a top wall 132, and opposing lateral sidewalls 134*a,b*. The back wall 130 may extend from the handle engagement surface 120 to the top wall 132. The back wall 130 may be substantially perpendicular to the handle engagement surface 120. The top wall 132 may have a curved surface that curves in a downward direction towards the front wall 128. The intersection of the top wall 132 and the front wall 128 may define a lip 136. The lip 136 may act as a catch to help secure the handle 116 to the spine layer 114, as discussed in more detail below. The lateral sidewalls 134*a,b* may be flat and may each include a fastening aperture 138*a,b* for receiving one or more fasteners 140*a,b* to couple the anchors 124*a,b* within the corresponding cavities 126*a,b* defined within the handle 116. As shown in FIGS. 5A and 5B, each anchor 124*a,b* may be at least partially hollow, and in one example forms a respective cavity 142*a,b*, such that one or more fasteners 140*a,b* extend through each fastening aperture 138*a,b* and through the cavity 142*a,b* of the respective anchor 124*a,b*. However, it is also contemplated that in some embodiments each anchor 124*a,b* may be solid and the fastening apertures 138*a,b* may be defined at least partially therethrough. In such embodiments, the fastening apertures 138*a,b* may extend entirely through the solid anchor 124*a,b* such that the fastening apertures 138*a,b* are operably connected to each other. Alternatively, the fastening apertures 138*a,b* may extend only partially through the solid anchors 124*a,b* such that the fastening apertures 138*a,b* are not operably connected to each other. While the embodiments discussed above include two fastening apertures 138*a,b* (e.g., a fastening aperture 138*a,b* defined in each lateral sidewall 134*a,b*), it is also contemplated that there may be only one fastening aperture (e.g., defined in only one lateral sidewall 134*a,b*) or more than two fastening apertures or the fastening apertures may be omitted. Other anchor shapes are also contemplated. For example, each anchor 124*a,b* may have a cross section that is key-shaped, cylindrical, or the like.

The anchors 124*a,b* may be positioned on the handle engagement surface 120 a distance apart. In some embodiments, the distance may be shorter than a length of the handle 116 (e.g., the length extending between opposing ends 122*a,b* of the handle 116). The anchors 124*a,b* may be positioned proximate opposing ends of the spine layer 114. The anchors 124*a,b* may be positioned on the spine layer 114 such that the front wall 128 of each anchor 124*a,b* faces outwards (e.g., away from the other anchor 124*b,a*); however, it is also contemplated that the front wall 128 of each anchor 124*a,b* may face towards one another. While two anchors 124*a,b* are depicted, it is contemplated that the spine layer 114 may include only one anchor (e.g., where the handle 116 couples to the spine layer 114 at only one end, as discussed in more detail below) or no anchors (e.g., where the handle 116 is coupled to the spine layer 114 at one or both ends by other fastening means, such as, for example, by welding, bonding, adhesion, or the like).

The spine layer 114 may be positioned on the front panel 104 to effectively support the load of a filled hydration bladder 102 when it is carried by the handle 116. For example, the spine layer 114 may be coupled to a generally central portion of the front panel 104 for even support on either side of the spine layer 114. For example, the spine layer 114 may be positioned substantially equal distance from the top and bottom edges 144,146 of the reservoir 100 and/or substantially equal distance from the opposing side edges 148*a,b* of the reservoir 100. For example, the spine layer 114 may be positioned along a center line of the front panel 104. In some embodiments, the spine layer 114 may be positioned substantially between the fill opening 150 and the outlet port 152. As discussed in more detail below, in some embodiments, the fill opening (or fill port) 150 may be formed by a fill opening collar 206 extending outwardly from the front panel 204. In these embodiments, the spine layer 114 may be coupled to the front panel 104 along a portion of the distance between the fill opening collar 206 and the outlet port 152. In some embodiments, the spine layer 114 may be positioned a distance from the fill opening 150 and/or a distance from the outlet port 152. In one embodiment, the spine layer 114 may be positioned equal distance from both the fill opening 150 and the outlet port 152. In an alternate embodiment, the spine layer 114 may be positioned a greater distance from at least one of the fill opening 150 and the outlet port 152. For example, the spine layer 114 may be positioned ¼", ½", ¾", 1" or more away from the fill opening 150. In embodiments with a fill opening collar 206, the spine layer 114 may be positioned away from the fill opening collar 206. In other embodiments, the spine layer 114 may be positioned adjacent or coupled to one or both of the fill opening 150 and the outlet port 152. For example, as shown in FIGS. 1-5A, the spine layer 114 may abut or couple with the outlet port 152. For example, the spine layer 114 may extend peripherally around at least a portion of the outlet port 152. In some embodiments, the spine layer 114 may extend entirely around the outlet port 152. In some embodiments, the spine layer 114 may be integral with the reinforcement panel 154 of the outlet port 152. For example, the spine layer 114 may extend to and encompass the outlet port 152. In some embodiments, as shown in dashed lines in FIGS. 1 and 2, the spine layer 114 may extend peripherally around at least a portion of the periphery of the fill opening 150. For example, the spine layer 114 may extend peripherally around at least a portion of the periphery of the fill opening collar 206. In some embodiments, the spine layer 114 may extend entirely around the fill opening 150. For example, the spine layer 114 may extend entirely around the fill opening collar 206. In some of the embodiments where the spine layer 114 extends around at least a portion of the periphery of the fill opening 150, the handle 116 may extend up to the edge or couple with the fill opening 150, or, alternatively, the handle 116 may be spaced away from the fill opening 150. For example, the handle 116 may engage the fill opening collar 206 or may be spaced away from the fill opening collar 206.

Figure 2:
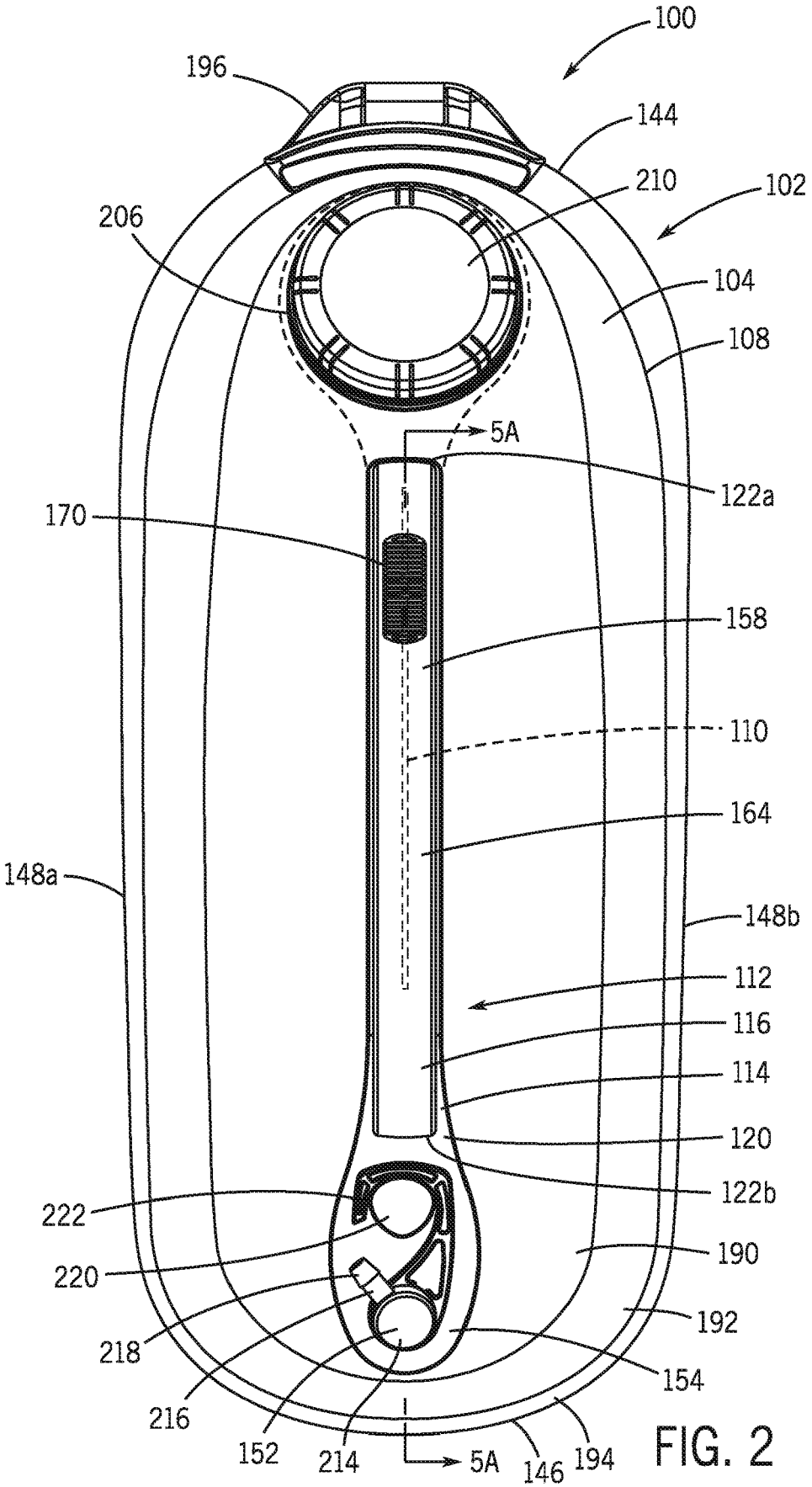
FIG. 2 is a front elevation view of the hydration reservoir of FIG. 1 in accordance with some examples of the present disclosure.
Figure 3:
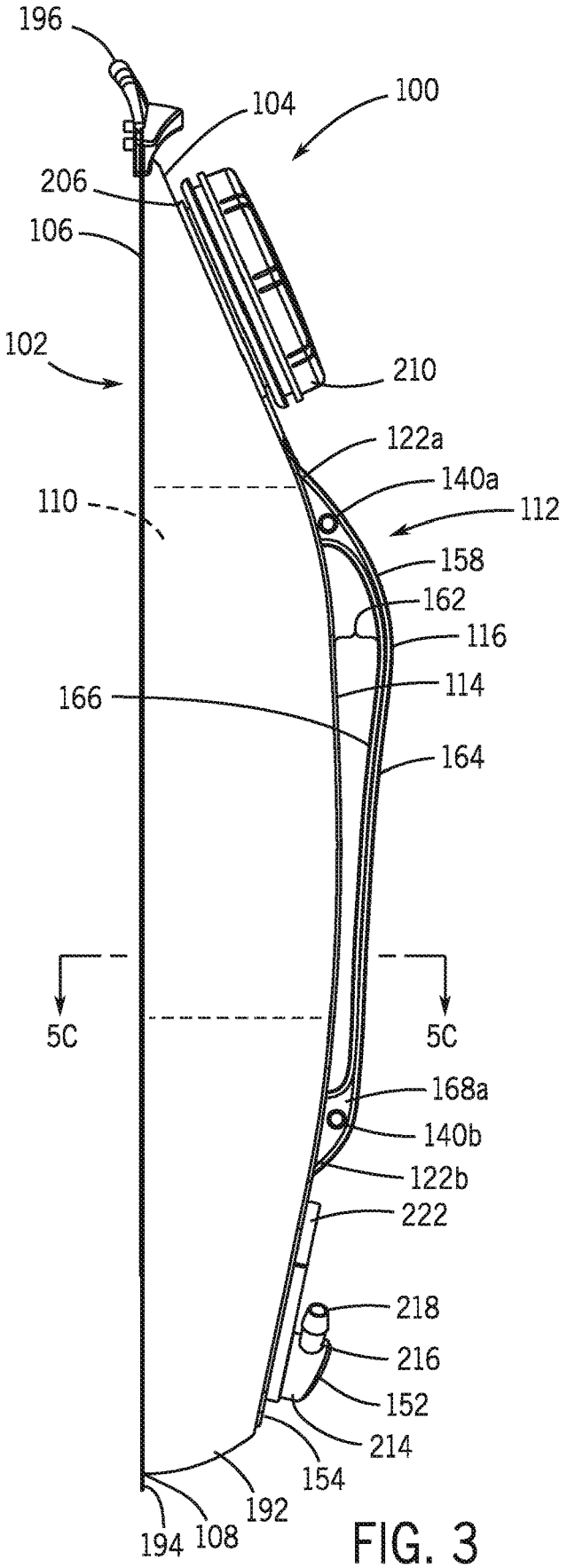
FIG. 3 is a side elevation view of the hydration reservoir of FIG. 1 in accordance with some examples of the present disclosure.

In some embodiments, for example as shown in FIGS. 1-3, the spine layer 114 extends longitudinally (e.g., in a direction from the top edge 144 to the bottom edge 146 of the front panel 104) along at least a portion of the length of the front panel 104. In other embodiments, the spine layer 114 may extend laterally (e.g., between opposing side edges 148*a,b* of the bladder 102) across at least a portion of the width of the front panel 104. In some embodiments, the spine layer 114 may extend both longitudinally and laterally. In some embodiments, for example as shown in FIGS. 3-5A, 5C, the hydration reservoir 100 may include an internal baffle 110 positioned within the hydration bladder 102, as discussed in more detail below. The baffle 110, in one example, is a sheet of plastic or other flexible material connected along one portion to the front panel 104 and connected along another portion to the rear panel 106. The spine layer 114 may be engaged with the front panel 104 in a region that at least partially aligns with the attachment location of the baffle 110 with the front panel 104. The stacking of at least a portion of the spine layer 114 with the attachment location of the baffle 110 with the front panel 104 may align with the position of the internal baffle 110. For example, the internal baffle 110 may extend longitudinally between the fill opening 150 and the outlet port 152. For example, the internal baffle 110 may extend along at least a portion of the distance between the fill opening collar 206 and the outlet port 152. The spine layer 114 may extend along at least a portion of a length of the internal baffle 110 (e.g., the spine layer 114 may be at least partially co-extensive with the internal baffle 110) to provide additional strength to the rear panel 106 of the hydration reservoir 100 so that it does not droop away from the front panel 104 when the bladder 102 is filled with water. As one example, the spine layer 114 may overlay only a portion of the top attachment of the internal baffle 110 in a discrete manner. As another example, the spine layer 114 may extend along the entire length of the internal baffle 110. In the embodiment shown in FIGS. 3-5A, the spine layer 114 extends beyond the length of the internal baffle 110. In an alternate embodiment where the hydration reservoir 100 includes an internal baffle 110, the spine layer 114 may not align with the internal baffle 110. In this embodiment, for example, the spine layer 114 may be positioned adjacent the internal baffle 110, may abut but not overlay the top attachment of the internal baffle 110, may be positioned in an opposing direction than the direction of the internal baffle 110 (e.g., where the internal baffle 110 extends longitudinally, the spine layer 114 extends laterally, and vice versa), or may be positioned in any other non-aligning manner.

Figure 6A:
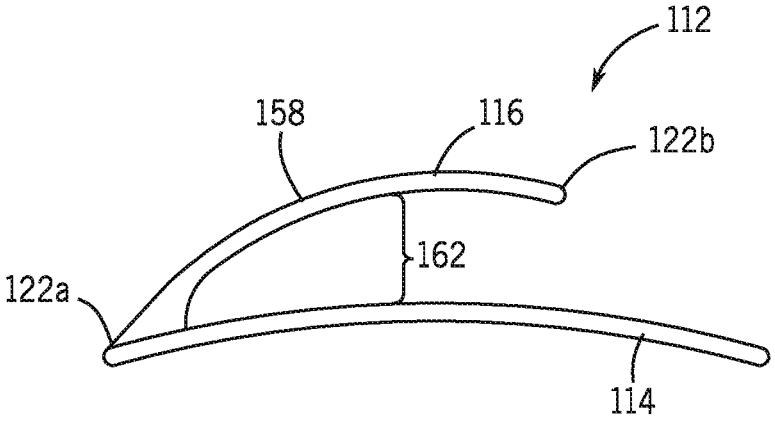
FIG. 6A is a side elevation view of an alternate handle assembly that can be used with the hydration reservoir of FIG. 1.
Figure 6B:
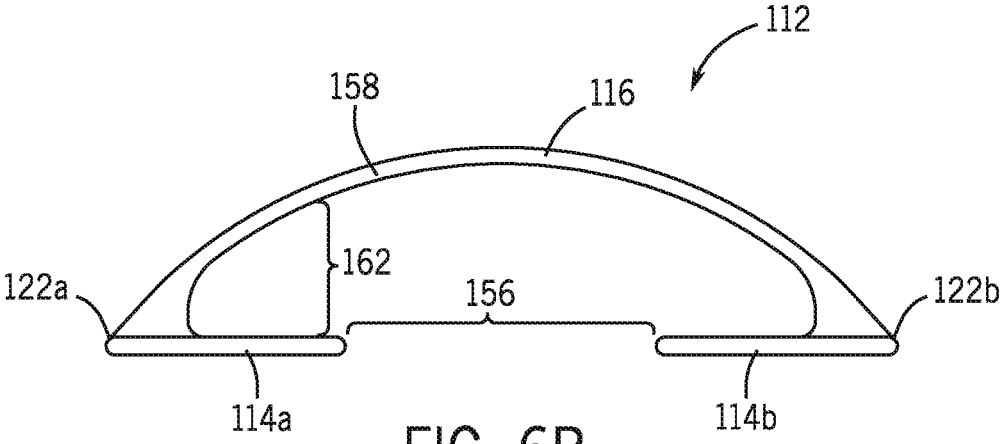
FIG. 6B is a side elevation view of an alternate handle assembly that can be used with the hydration reservoir of FIG. 1.

The peripheral shape of the spine layer 114 may vary. For example, in some embodiments, the spine layer 114 may have a substantially rectangular shape. In the embodiments shown in FIGS. 1-4, the spine layer 114 has a substantially rectangular shape with at least one oval-shaped end. In these embodiments, the spine layer 114 is linear. In other embodiments, the spine layer 114 may have a non-linear shape, such as is shown by example in FIG. 7, where the spine layer 114 has a curved shape. The spine layer 114 may have a uniform thickness (e.g., the distance between the panel engagement surface 118 and the handle engagement surface 120) throughout; however, it is also contemplated that the thickness of the spine layer 114 may change along its length. The spine layer 114 may be a single, continuous component (e.g., FIGS. 1-6A) coupled continuously with the front panel 204; however, it is also contemplated that the spine layer 114 may be discontinuous and made of several segments. For example, the spine layer 114 may extend discontinuously along a length of the front panel 204. For instance, as shown in FIG. 6B, the spine layer 114 is made of two distinct segments 114*a,b* separated by a gap 156.

In several embodiments, as shown in FIGS. 1-5B, the handle 116 may extend from the spine layer 114 to form a grip portion 158 for a user to grasp. The grip portion 158 may be formed by an intermediate or middle region between the two opposing end portions 122*a,b*. One of the opposing ends (e.g., a first end 122*a*) may engage or be coupled to the spine layer 114 near or proximate the fill opening 150 and the other opposing end (e.g., a second end 122*b*) may engage or be coupled to the spine layer 114 at a location closer to the outlet port 152 than the fill opening 150. For example, the other opposing end may engage or be coupled to the spine layer 114 proximate or adjacent the outlet port 152. The opposing ends 122*a,b* may each have an attachment structure 160*a,b* (e.g., an attachment surface or region) that couples with the respective end of the spine layer 114. A gap 162 may be formed between the grip portion 158 of the handle 116 and the spine layer 114 when the handle 116 is coupled to the spine layer 114. The gap 162 may extend along the length of the handle 116 from the first end 122*a* of the handle 116 to the second end 122*b* of the handle 116. The gap 162 may have a larger size or dimension near one end of the handle 116 as compared to a size or dimension of the gap 162 near the opposing end. For example, as shown in FIG. 3, the gap 162 may have a larger size or dimension near the first end 122*a* of the handle 116 than the second end 122*b* of the handle 116; however, it is also contemplated that the gap 162 may have a larger size or dimension near the second end 122*b* and a smaller size or dimension near the first end 122*a*. In an alternate embodiment, the gap 162 may have a consistent size or dimension along the length of the handle 116. In some embodiments, the gap 162 may be omitted. As one example, the handle 116 may be a rib protruding along a length of the spine layer 114.

The handle 116 may be ergonomically shaped to be comfortably grasped by a user's hands and/or fingers. For example, the handle 116 may have a top and bottom surface 164,166 with opposing lateral sides 168*a,b*. The opposing lateral sides 168*a,b* may form sidewalls, edges, or portions of the handle 116 extending between the top and bottom surface 164,166. The handle 116 may have a lateral width defined between the lateral sides 168*a,b* and a thickness defined between the top and bottom surfaces 164,166. The lateral width may be consistent along the length of the handle 116 or it may vary. For example, the lateral width of the opposing ends 122*a,b* of the handle 116 may be greater than the lateral width of the grip portion 158 of the handle 116, or vice versa. The thickness may be consistent along the length of the handle 116 or it may vary. For example, the thickness of the opposing ends 122*a,b* of the handle 116 may be greater than the thickness of a middle region (e.g., the grip portion 158) of the handle 116, or vice versa. The cross-sectional shape of the handle 116 may be substantially rectangular, cylindrical, elliptical, or other shape. The cross-sectional shape may be consistent along the length of the handle 116 or it may vary. In one embodiment, the handle 116 may be rigid and not deflect when in use. In an alternate embodiment, the handle 116 may be somewhat flexible to allow some deflection when in use.

In one embodiment, as shown in FIGS. 1-5A, the handle 116 may have a top surface 164, a bottom surface 166, and opposing lateral sidewalls 168*a,b*. The top and bottom surfaces 164,166 may be substantially curved surfaces. As shown in FIGS. 1 and 2, the lateral width is substantially the same along the length of the handle 116. As shown in FIGS. 3-5A, the thickness is greater near the opposing ends 122*a,b* than in the grip region 158. The shape of each end 122*a,b* of the handle 116 defines the surface area of the attachment to the spine layer 114, and thus the structural characteristics of the engagement. For instance, a larger end may increase the surface area of the attachment structures 160*a,b* to help distribute load between the handle 116 and the spine layer 114.

The handle 116 may include a grip surface 170 to prevent the handle 116 from slipping out of a user's hand. The grip surface 170 may be a material co-molded on the handle 116, a high friction surface treatment, and/or a surface feature (e.g., ribs, grooves, or the like). As shown in FIGS. 1, 2, and 4, the grip surface 170 may be positioned on the grip portion 158 of the top surface 164 such that a user can engage the grip surface 170 with the user's thumb while grasping the grip portion 158 of the handle 116. As depicted in these examples, the grip surface 170 is positioned proximate the first end 122*a* (proximate the fill opening 150). In some embodiments, the grip surface 170 may cover the entire top surface 164. In some embodiments, the grip surface 170 may cover the top surface 164 across the entire grip portion 158 (e.g., not at the opposing ends 122*a,b*). In some embodiments, the bottom surface 166 of the handle 116 may include a grip surface 170 along a portion of or the entirety of the bottom surface 166. In some embodiments, the entire handle 116 may comprise a grip material. The grip surface 170 or material may be made of thermoplastic, rubber, silicone, or the like.

As shown in FIG. 5, each opposing end 122*a,b* of the handle 116 may include a cavity 126*a,b* defined therein. For example, the cavities 126*a,b* may be defined in the attachment structure 160*a,b* of each end 122*a,b*. The cavities 126*a,b* may be sized to receive and selectively retain the anchors 124*a,b* of the spine layer 114. For example, each cavity 126*a,b* may have a shape corresponding to the shape of the anchor 124*a,b* to which it will be engaged. For instance, each cavity 126*a,b* may have walls corresponding to the walls of the corresponding anchor 124*a,b* and a shoulder 172 that acts as a catch for the corresponding anchor 124*a,b* lip 136. For example, each cavity 126*a,b* may include a back wall 174, a top wall 176, a front wall 178, and opposing lateral sidewalls 180*a,b*. The back wall 174 may be substantially parallel to the bottom surface 166 of the handle 116. The top wall 176 may intersect with the back wall 174 and curve down towards the attachment structure 160*a,b* of the handle 116. The front wall 178 may define a shoulder 172 that acts as a catch to help secure the handle 116 to the spine layer 114. The opposing lateral sidewalls 180*a,b* of the cavity 126*a,b* may each have a fastener receiving aperture 182*a,b* defined therethrough that aligns with the aperture 138*a,b* formed through the corresponding lateral sidewalls 134*a,b* of the anchor 124*a,b*.

The handle 116 may be coupled to the spine layer 114 in the handle assembly 112 by a connection assembly 184. As shown in FIGS. 4-5B, the connection assembly 184 includes the anchors 124*a,b*, the handle cavities 126*a,b*, and one or more fasteners 140*a,b*. In several embodiments, the connection assembly 184 secures the handle 116 to the spine layer 114 in the handle assembly 112. For example, as shown in FIGS. 5A-B, the cavities 126*a,b* of the handle 116 may align with the anchors 124*a,b* of the spine layer 114. The anchors 124*a,b* may be received within the cavities 126*a,b*. The cavities 126*a,b* may selectively retain the anchors 124*a,b* (e.g., through interference fit) such that the handle 116 and spine layer 114 are secured together. For example, the back wall 130, top wall 132, and opposing lateral sidewalls 134*a,b* of each anchor 124*a,b* may align with the respective back wall 174, top wall 176, and opposing lateral sidewalls 180*a,b* of the respective cavity 126*a,b*. The lip 136 of each anchor 124*a,b* aligns with the shoulder 172 of each respective cavity 126*a,b* to act as a catch to help secure the handle 116 to the spine layer 114.

The one or more fasteners 140*a,b* may be any conventional fastener. As one example, as shown in FIG. 4, a fastener 140*a,b* of the connection assembly 184 may have a substantially cylindrical shaft 186. Each opposing end 188*a,b* of the fastener 140*a,b* may define a head. The head may be a flange that has a diameter greater than the diameter of the cylindrical shaft 186. One end 188*b* of the fastener 140*a,b* may be removable from the cylindrical shaft 186 to facilitate installation of the fastener 140*a,b* when the end 188*b* is removed and to secure the fastener 140*a,b* when the end 188*b* is secured to the shaft 186. The fastener 140*a,b* may act as a retention/securement pin to secure the handle 116 to the spine layer 114, as discussed in more detail below.

The one or more fasteners 140*a,b* may extend through the fastener receiving apertures 182*a,b* of the lateral sidewalls 180*a,b* of each cavity 126*a,b* and through the fastening apertures 138*a,b* of the lateral sidewalls 134*a,b* of the respective anchor 124*a,b* to secure the anchor 124*a,b* and cavity 126*a,b*. The heads 188*a,b* of the fastener 140*a,b* may seat within the fastener receiving apertures 182*a,b* proximate the lateral sides 168*a,b* of the handle 116. While the handle assembly 112 is depicted with the connection assembly 184 connecting the handle 116 with the spine layer 114, it is contemplated that the handle 116 may be coupled to the spine layer 114 by any joint that is fixably secured. For example, the handle 116 and spine layer 114 may be coupled by another type of connector joint, a lap joint with a key, a clevis joint, and the like. It is also contemplated that the handle 116 and spine layer 114 may be coupled by other conventional means, such as, for example, by adhesive, heat molding, and the like. As one example, the handle 116 may be co-molded to the spine layer 114. In some embodiments, the handle 116 may be integral with the spine layer 114 such that the handle assembly 112 is a single component. While the depicted embodiment shows the handle 116 with two cavities 126*a,b* and four fastener receiving apertures 182*a,b*, it is also contemplated that the handle 116 may be entirely solid with no cavities or apertures defined therethrough or that the handle 116 may have fewer than two cavities and/or four fastener receiving apertures (e.g., where the handle 116 is coupled to the spine layer 114 by the other conventional means discussed above, by just the lip 136/shoulder 172 coupling, by a single handle end, etc.).

It is contemplated that the handle 116 may be coupled to the spine layer 114 at varying positions and orientations. In one embodiment, the handle 116 may be coupled to the spine layer 114 at both ends 122*a,b* of the handle 116. For example, both ends 122*a,b* may be bonded to the spine layer 114. As another example, as shown in FIGS. 1-3, 5A, and 6B, the attachment structure 160*a,b* of each end 122*a,b* of the handle 116 may contact the handle engagement surface 120 of the spine layer 114. As shown in FIG. 6B, the opposing ends 122*a,b* of the handle 116 may couple to separate segments 114*a,b* of the spine layer 114. In an alternate embodiment, the handle 116 may be coupled to the spine layer 114 at one end of the handle 116. In this embodiment, the other end of the handle 116 is free and the grip portion 158 defines a cantilever. For example, as shown in FIG. 6A, the handle 116 is coupled to the spine layer 114 at the first end 122*a* of the handle 116. In this example, the second end 122*b* of the handle 116 is suspended (e.g., above the spine layer 114). In this example, only the first end 122*a* of the handle 116 has an attachment structure 160*a* that contacts the handle engagement surface 120 of the spine layer 114, while the second end 122*b* does not have an attachment structure. In this example, the thickness of the handle 116 in the grip portion 158 and at the second end 122*b* may be substantially the same, while the thickness of the handle 116 may be greater proximate the first end 122*a* and the respective attachment structure 160*a*. In either embodiment, the handle 116 may be coupled to the spine layer 114 at a location spaced away from the fill opening 150. For example, the handle 116 may be positioned ¼", ½", ¾", 1" or more away from the fill opening 150. For example, the handle 116 may be spaced away from the fill opening collar 206.

As shown in FIGS. 1-6B, the handle 116 may extend along the length of the spine layer 114, such as over or co-extensive with the extension of the spine layer 114. However, it is contemplated that the handle 116 may not extend in that manner and may instead extend in a different direction than the direction of the spine layer 114. For example, the grip portion 158 of the handle 116 may be in a different position and/or location than the spine layer 114. In some embodiments, for example, as shown in FIGS. 1-3 and 5A, the handle 116 may extend along substantially the entire length of the spine layer 114. In other embodiments, for example, as shown in FIG. 6A, the handle 116 may extend along only a portion of the length of the spine layer 114. In an alternate embodiment, the handle 116 may extend beyond the length of the spine layer 114 (e.g., the spine layer 114 may have a shorter length along the length of the front panel 104 than the length of the handle 116 along the front panel 104).

In some embodiments, the hydration reservoir 100 may be shaped such that the inner surfaces of each panel 104,106 come in contact when the bladder 102 is empty. In other embodiments, the hydration reservoir 100 may be shaped to create a space between the inner surfaces of each panel 104,106 when the bladder 102 is empty, which reduces the contact between the front and rear panels 104,106. For example, the hydration reservoir 100 may be the same or similar to the hydration reservoir disclosed in U.S. Patent Publication No. 20170086568 A1, filed 21 Apr. 2016, and entitled "Hydration Reservoir," which is hereby incorporated by reference herein in its entirety. For example, at least one of the front and rear panels 104,106 may be molded into a three-dimensional shape to space at least a portion of the front and rear panels 104,106 away from each other when the bladder 102 is empty. In such embodiments, one panel may be substantially flat to limit barreling into a back panel of a hydration pack or into the back of a user.

In some embodiments, the front panel 104 may be formed from a plurality of panel portions connected together. For example, the front panel 104 may be formed from a center panel portion 190 and one or more side panel portions 192. Additionally or alternatively, the rear panel 106 may be constructed from a plurality of panel portions in a similar manner. The front and rear panels 104,106 may also each be formed from a unitary sheet, or may be formed as portions of a unitary sheet of material. In some embodiments, one portion of the unitary sheet of material may be molded into a formed three-dimensional shape.

Both the front and rear panels 104,106 are resiliently deformable and flexible, and in some embodiments, the rear panel 106 may be more flexible than the front panel 104, or vice versa. Due to the deformability of the front and rear panels 104,106, the space between the front and rear panels 104,106 may be reduced as a user removes air and/or liquid from the bladder 102, greatly reducing any sloshing effect compared to a hard-molded reservoir.

The front panel 104 and the rear panel 106 may be welded or otherwise hermetically sealed together along a line of connection, such as around their respective peripheries to define the bladder 102. For example, the outer edge of the front panel 104 may be welded to the confronting adjacent outer edge of the rear panel 106 to form a leak-proof seal, which forms a flange 194 extending around the periphery of the bladder 102. When assembled, the flange 194 defines a top edge 144, a bottom edge 146, and opposing side edges 148*a,b* of the bladder 102, with the opposing side edges 148*a,b* extending between the top edge 144 and the bottom edge 146.

With reference to FIGS. 1-4, the hydration reservoir 100 may include a rigid clip 196 connected to at least the top edge 144 of the bladder 102. As shown, the clip 196 extends along at least a portion of the top edge 144. The clip 196, which may be referred to as a frame or a grip, may include a first member 198 and a second member 200 connected together to position the clip 196 adjacent the top edge 144 of the bladder 102. For example, the first member 198 may include an engagement surface from which a plurality of projections extends. The second member 200 may include a corresponding engagement surface in which a plurality of cavities 202 are defined, the cavities 202 sized to receive and selectively retain the projections of the first member 198. In some embodiments, retention holes 204 may be defined in the top edge 144 and/or the opposing side edges 148*a,b* of the bladder 102, such as in the flange 194 portion extending around the periphery of the bladder 102. In such embodiments, the projections of the first member 198 extend through the retention holes 204 of the bladder 102 and are received in the cavities 202 of the second member 200. The cavities 202 may selectively retain the projections of the first member 198 (e.g., through interference fit) such that the first and second members 198,200 are secured together. In some embodiments, the clip 196 may extend around the entire periphery of the bladder 102 and, in such embodiments, may be formed integrally with a perimeter frame. The clip 196 may be curved, and, in some embodiments, may include a hanger for attachment of the hydration reservoir 100 to a hydration pack, backpack, or other suitable carrier.

As discussed above, with reference to FIGS. 1-4, the hydration reservoir 100 may include a fill opening 150 and an outlet port 152 spaced away from the fill opening 150. As shown in FIG. 4, the fill opening 150 is defined in the front panel 104 (e.g., on the center panel portion 190). The fill opening 150 may be defined in the front panel 104 adjacent (e.g., spaced away from) the top edge 144 of the bladder 102. The fill opening 150 may include a fill opening collar 206 positioned over top of the fill opening 150 and coupled to the front panel 104. The fill opening collar 206 defines an aperture 208 that aligns with the fill opening 150 to allow access to the fill opening 150. A cap 210 may be positioned over top of the fill opening collar 206 to selectively close the fill opening 150 and prevent the contents of the bladder 102 from spilling out. For example, the cap 210 may be a standardized screw cap (e.g., 63 mm or 80 mm) with a quick securement and/or release mechanism (e.g., lA turn to open or shut). In some embodiments, a tether mechanism may retain the screw cap 210 adjacent the fill opening collar 206 when the bladder 102 is being filled with liquid, for instance.

Figure 7:
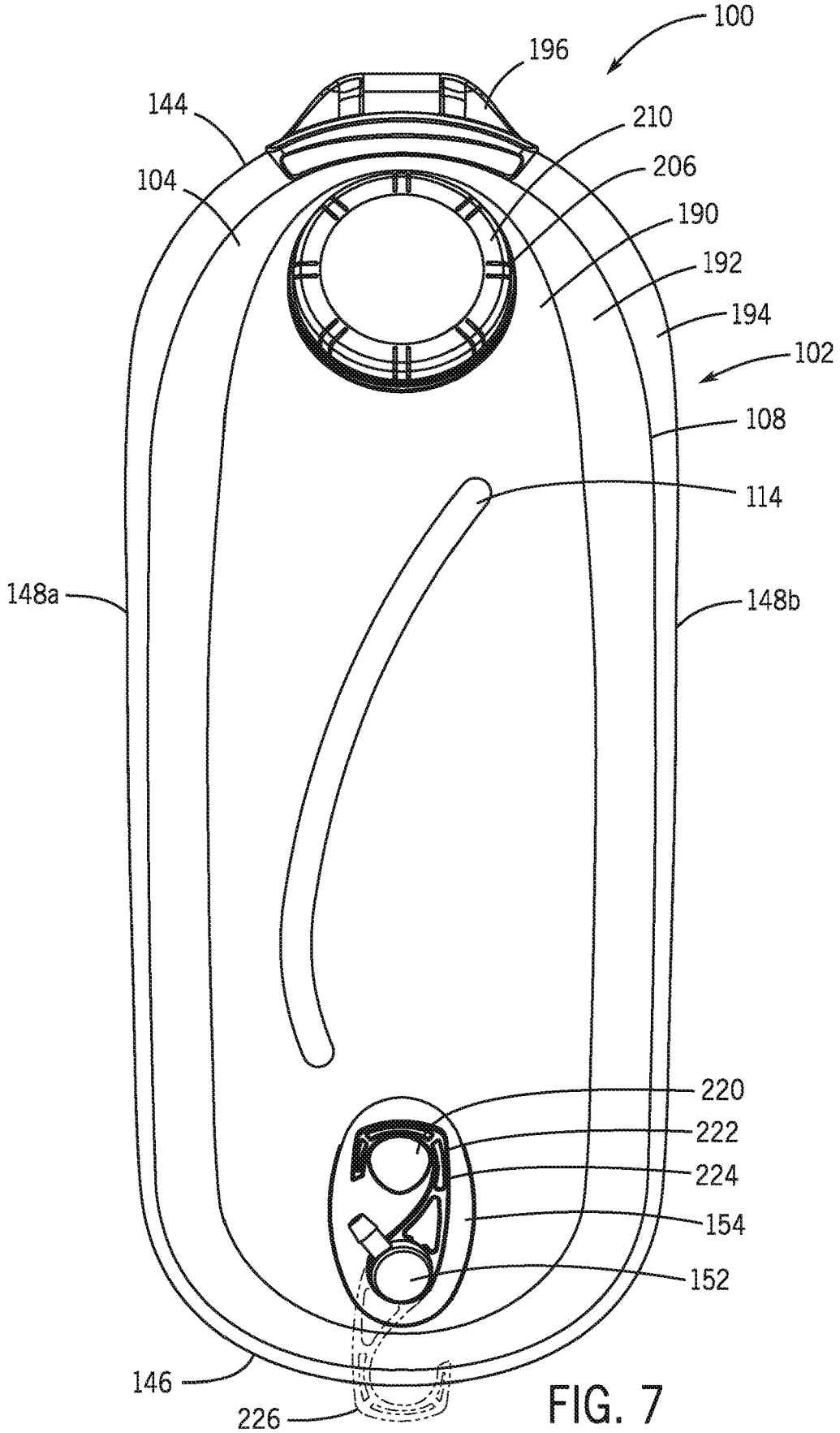
FIG. 7 is a front elevation view of an additional hydration reservoir in accordance with some examples of the present disclosure.

As shown in FIG. 4, the outlet port 152 is positioned over an outlet aperture 212 that is defined in the front panel 104 (e.g., on the center panel portion 190) at an opposite end portion of the bladder 102 from the fill opening 150. For example, the outlet aperture 212 may be defined in the front panel 104 adjacent (e.g., spaced away from) the bottom edge 146 of the bladder 102. The outlet port 152 is operable to connect to an outlet hose from which the user may receive the fluid in the reservoir 100. The outlet port 152, in one example, may include a first portion 214 that extends away from the front panel 104 of the bladder 102 and a second portion 216 extending generally perpendicular to the first portion 214. As illustrated, the second portion 216 of the outlet port 152 may include a barbed fitting 218 for connecting to an outlet hose, although other types of connection mechanisms may be used to secure the outlet hose to the outlet port 152. The outlet port 152 may include an outlet reinforcement panel 154 surrounding the first portion 214 of the outlet port 152. As shown in FIG. 7, the outlet reinforcement panel 154 may have an oval shape; however, any of a variety of shapes are also contemplated. The outlet reinforcement panel 154 may have a width that is sized to decrease stress on the periphery of the outlet aperture 212 in the front panel 104, where the outlet port 152 is secured to the outlet aperture 212. The outlet reinforcement panel 154 may include a retaining member 220 extending therefrom to hold a securement feature 222 in a stored position, as discussed in more detail below.

With continued reference to FIGS. 1-4 and 7, the hydration reservoir 100 may include a movable securement feature 222, such as a hook-shaped member, for conveniently hanging the reservoir 100, and which is useful for drying the reservoir 100. The securement feature 222 may be positioned on a lower portion of the bladder 102 and may be rotatable relative to the outlet port 152 and/or bladder 102. For example, as shown in the embodiments of FIGS. 1 and 2, the securement feature 222 is a hook rotatably coupled to the outlet port 152. For example, the securement feature 222 may be rotatably coupled to the first portion 214 of the outlet port 152 such that the securement feature 222 extends generally parallel to the front panel 104. The securement feature 222 may be positioned at least partially between the front panel 104 and the second portion 216 of the outlet port 152, such that the second portion 216 of the outlet port 152 retains the securement feature 222 in position.

In some embodiments, as shown in FIG. 7, the securement feature 222 may be selectively deployable between a stored position 224 and an operable position 226. In the stored position 224, the securement feature 222 may be rotated relative to the outlet port 152 and the bladder 102 such that the securement feature 222 is positioned substantially between the outlet port 152 and the fill opening 150. In some embodiments, the retaining member 220 may selectively retain the securement feature 222 in the stored position 224. In the operable position 226 (e.g., as shown in dashed lines in FIG. 7), the securement feature 222 may be rotated relative to the bladder 102 such that a portion of the securement feature 222 extends below the bottom edge 146 of the bladder 102. In this manner, the securement feature 222 provides the user a quick mechanism to hang the hydration reservoir 100 from a support member (e.g., a hanger, coat or closet hook, etc.).

With reference to FIGS. 1, 3, 4, 5A, and 5C, the hydration reservoir 100 may include an internal baffle 110 to limit barreling or sloshing of liquid within the bladder 102. In these embodiments, the internal baffle 110 is positioned inside the bladder 102 and is connected to the front and rear panels 104,106 (e.g., between the center panel portion 190 and the rear panel 106). In one example, the internal baffle 110 is a sheet of plastic or other flexible material connected along one portion to the front panel 104 and connected along another portion to the rear panel 106. In some embodiments, the internal baffle 110 may extend longitudinally between the fill opening 150 and the outlet port 152; however, it is also contemplated that the internal baffle 110 may extend laterally between the opposing side edges 148*a,b* of the bladder 102. In other embodiments, the internal baffle 110 may extend both longitudinally and laterally. The internal baffle 110 may be positioned centrally along the lateral width of the bladder 102 such that the internal baffle 110 is equal distance from the opposing side edges 148*a,b* of the bladder 102. The internal baffle 110 may have a generally rectangular shape and may include top and bottom edges 228,230 and opposing side edges 232*a,b*; however, other shapes are contemplated. The internal baffle 110 may be coupled to the front panel 104 along at least a portion of the top edge 228, and to the rear panel 106 along at least a portion of the bottom edge 230. For example, the internal baffle 110 may be coupled along the entire top edge 228 to the front panel 104 and along the entire bottom edge 230 to the rear panel 106. The internal baffle 110 may be attached along the top edge 228 continuously or intermittently to the front panel 104 and along the bottom edge 230 continuously or intermittently to the rear panel 106. The internal baffle 110 may be coupled to the front and rear panels 104,106 by various means, such as, for example, by heat bonding, sonic welding, and the like. While one internal baffle 110 is shown in the figures, no internal baffle 110 or more than one internal baffle 110 is contemplated. In an embodiment with multiple internal baffles 110, the internal baffles 110 may be aligned along the longitudinal length of the bladder 102, aligned along the lateral width of the bladder 102, positioned adjacent to one another, intersect, extend parallel to one another, extend orthogonal to one another, be positioned on opposing sides of a center line of the bladder 102, be positioned on the center line of the bladder 102, and the like.

Like the front and rear panels 104,106, the internal baffle 110 may be formed from one or more layers of soft film, and may be formed monolithically with at least one of the front and rear panels 104,106. In some embodiments, the internal baffle 110 may be operable to limit and/or define the space between the front and rear panels 104,106 of the bladder 102. For example, the internal baffle 110 may help define the overall three-dimensional shape of the bladder 102 for embodiments in which the bladder 102 is three-dimensional. When the bladder 102 is filled with liquid, the internal baffle 110 may limit the bladder 102 from bulging outward or barreling away from either the rear panel 106, the front panel 104, or both the front and rear panels 104,106.

The hydration reservoir 100 may be formed from a variety of materials and means.

For example, the bladder 102, including the front and rear panels 104,106 and the internal baffle 110, if any, may be formed from metallocene, thermoplastic polyurethane, or a combination of polyurethane and polyethylene, and may or may not be treated with an anti-bacterial treatment. The clip 196, outlet port 152, screw cap 210, fill opening collar 206, securement feature 222, handle 116, and spine layer 114 may be formed from a thermoplastic material (self-reinforced or fiber reinforced), LDPE, ABS, polycarbonate, polypropylene, polystyrene, PVC, polyamide, and/or PTFE, among others, and may be formed or molded in any suitable manner, such as by plug molding, blow molding, injection molding, or the like.

The handle assembly 112 may be made of the same material throughout. For example, both the spine layer 114 and the handle 116 may be made of the same material. Alternatively, the spine layer 114 may be made of a different material than the handle 116. For example, the spine layer 114 may be made of a first material and the grip portion 158 of the handle 116 may be made of a second material different from the first material. The spine layer 114 may be substantially the same material as the outlet port 152. Alternatively, the spine layer 114 may be made of a different material than the outlet port 152. At least one of the spine layer 114, handle 116, and outlet port 152 may be made of multiple materials. For example, at least one of the spine layer 114, handle 116, and outlet port 152 may be co-molded with two materials (e.g., hard plastic and TPU). As another example, the spine layer 114 may have a different material on the panel engagement surface 118 than the handle engagement surface 120. Alternatively, at least one of the spine layer 114, handle 116, and outlet port 152 may have a consistent material throughout. As one example, the spine layer 114 may be formed of a strip of sheet material. For example, the spine layer 114 may be formed by a long strip of sheet material coupled to the front panel 204 by bonding.

Additionally, the thicknesses of the front and rear panels 104,106 may be consistent, or may vary across the bladder 102 depending on the desired flexibility, strength, and/or weight of the bladder 102. For instance, the thicknesses of the front and rear panels 104,106 may be greater near the edges, the fill opening 150, and/or the outlet port 152. Similarly, the thicknesses of the center panel portion 190 and the one or more side panel portions 192 may vary depending on a desired aesthetic or functional characteristic of the bladder 102.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. A hydration reservoir comprising:

a bladder for storing fluid defining a front panel and a rear panel;

a fill opening defined in the front panel, the fill opening formed by a fill opening collar extending outwardly from the front panel;

an outlet port defined in the front panel and spaced away from the fill opening at a distance; and a handle assembly coupled to the front panel, wherein the handle assembly comprises a spine layer coupled to the front panel and a handle protruding from the spine layer, wherein the handle is spaced away from the fill opening and fill opening collar and wherein the handle has a grip portion defining opposing ends, wherein one of the opposing ends engages the spine layer near the fill opening.

2. The hydration reservoir of claim 1, wherein the other of the opposing ends engages the spine layer at a location closer to the outlet port than the fill opening.

3. The hydration reservoir of claim 1, wherein a gap is formed between the spine layer and the grip portion.

4. The hydration reservoir of claim 1, wherein the other of the opposing ends is free and the grip portion defines a cantilever.

5. The hydration reservoir of claim 1, wherein the spine layer is coupled to the front panel at a location spaced away from the fill opening.

6. The hydration reservoir of claim 1, wherein the spine layer is coupled to the front panel along a portion of the distance between the fill opening and the outlet port.

7. The hydration reservoir of claim 6, wherein the spine layer is coupled to the front panel continuously.

8. The hydration reservoir of claim 6, wherein the spine layer extends to and encompasses the outlet port.

9. The hydration reservoir of claim 1, wherein the spine layer is formed by a long strip of sheet material coupled to the front panel by bonding.

10. The hydration reservoir of claim 1, further comprising a baffle positioned inside the bladder, wherein the baffle is coupled between the front and rear panels and extends along at least a portion of the distance between the fill opening and the outlet port, wherein the spine layer is at least partially co-extensive with the baffle.

11. The hydration reservoir of claim 1, wherein the handle assembly includes at least two materials, and wherein the spine layer includes a first material, and the grip portion includes a second material, and the first material and second material are different from one another.

12. The hydration reservoir of claim 1, wherein at least one of the front panel and the rear panel is molded into a three-dimensional shape.

13. The hydration reservoir of claim 1, wherein the spine layer comprises at least two anchors positioned a distance apart; and the handle comprises at least two cavities positioned at opposing ends of the handle;

wherein the at least two cavities couple with the at least two anchors to couple the handle with the spine layer.

14. A hydration reservoir comprising:

a bladder for storing fluid defining a front panel and a rear panel;

a fill opening defined in the front panel, the fill opening formed by a fill opening collar extending outwardly from the front panel;

an outlet port defined in the front panel and spaced away from the fill opening at a distance;

a handle assembly coupled to the front panel, wherein the handle assembly comprises a spine layer coupled to the front panel and a handle protruding from the spine layer, wherein the handle is spaced away from the fill opening and fill opening collar; and a baffle positioned inside the bladder, wherein the baffle is coupled between the front and rear panels and extends along at least a portion of the distance between the fill opening and the outlet port, wherein the spine layer is at least partially co-extensive with the baffle.

15. The hydration reservoir of claim 14, wherein the spine layer comprises at least two anchors positioned a distance apart; and the handle comprises at least two cavities positioned at opposing ends of the handle;

wherein the at least two cavities couple with the at least two anchors to couple the handle with the spine layer.

16. The hydration reservoir of claim 14, wherein the handle comprises:

a top surface;

a bottom surface; and two opposing ends, wherein each end comprises an attachment structure that couples the respective end to the spine layer;

wherein a distance between the top surface and the bottom surface defines a thickness of the handle and wherein the thickness of the opposing ends is greater than the thickness of a middle region of the handle.

17. The hydration reservoir of claim 14, wherein the handle assembly comprises a first end proximate the fill opening and a second end proximate the outlet port, wherein the gap is larger proximate the first end than proximate the second end.

18. A hydration reservoir comprising:

a bladder for storing fluid defining a front panel and a rear panel;

a fill opening defined in the front panel, the fill opening formed by a fill opening collar extending outwardly from the front panel;

an outlet port defined in the front panel and spaced away from the fill opening at a distance;

a handle assembly coupled to the front panel, wherein the handle assembly comprises a spine layer coupled to the front panel and a handle protruding from the spine layer; and a baffle positioned inside the bladder, wherein the baffle is coupled between the front and rear panels and extends along at least a portion of the distance between the fill opening and the outlet port, wherein:

the handle is spaced away from the fill opening and fill opening collar, and the handle has a grip portion defining opposing ends, wherein one of the opposing ends engages the spine layer near the fill opening, and the spine layer is at least partially co-extensive with the baffle.

19. The hydration reservoir of claim 18, wherein the spine layer comprises at least two anchors positioned a distance apart; and the handle comprises at least two cavities positioned at opposing ends of the handle;

wherein the at least two cavities couple with the at least two anchors to couple the handle with the spine layer.

20. The hydration reservoir of claim 18, wherein the handle assembly comprises a first end proximate the fill opening and a second end proximate the outlet port, wherein the gap is larger proximate the first end than proximate the second end.

* * * * *